US010974115B1

(12) United States Patent
Hatfield et al.

(10) Patent No.: US 10,974,115 B1
(45) Date of Patent: Apr. 13, 2021

(54) GOLF PUTTING TRAINING AID

(71) Applicants: Michael Luke Hatfield, Saint John (CA); Enrico G T Pianori, Arlington, TX (US); James Donn Hethcock, Jr., Colleyville, TX (US)

(72) Inventors: Michael Luke Hatfield, Saint John (CA); Enrico G T Pianori, Arlington, TX (US); James Donn Hethcock, Jr., Colleyville, TX (US)

( * ) Notice: Subject to any disclaimer, the term of this patent is extended or adjusted under 35 U.S.C. 154(b) by 0 days.

(21) Appl. No.: 16/266,062

(22) Filed: Feb. 2, 2019

(51) Int. Cl.
*A63B 69/36* (2006.01)
*A63B 69/00* (2006.01)

(52) U.S. Cl.
CPC ..... *A63B 69/0059* (2013.01); *A63B 69/36* (2013.01)

(58) Field of Classification Search
CPC ..... A63B 69/3608; A63B 2209/10; A63B 69/3676; A63B 69/0059; A63B 69/3641; A63B 69/3644; A63B 69/3685; A63B 69/365; A63B 69/3632; A63B 2071/0694; A63B 69/36
USPC ..... 473/207, 215, 216, 219, 223, 227, 229, 473/266, 277, 458
See application file for complete search history.

(56) References Cited

U.S. PATENT DOCUMENTS 4,479,653 A * 10/1984 Woodson ..... A63B 69/0059 473/215
6,270,430 B1 * 8/2001 Nicoloff ..... A63B 69/0026 473/207
6,364,786 B1 * 4/2002 Khano ..... A63B 69/3667 473/226
7,883,429 B1 * 2/2011 Chen ..... A63B 69/365 473/258
7,887,429 B2 * 2/2011 Nelson ..... A63B 69/3644 473/229
7,993,210 B1 * 8/2011 Hatfield ..... A63B 69/3608 473/215
8,298,094 B1 * 10/2012 Chen ..... A63B 69/3676 473/261
8,591,349 B1 * 11/2013 Jones ..... A63B 69/3676 473/229
8,657,698 B2 * 2/2014 Basile ..... A63B 69/3685 473/229

* cited by examiner

*Primary Examiner* — Nini F Legesse

(57) ABSTRACT

A golfing appartaus for assisting a golfer in putting includes a guide member adapted to encourage only certain motions during the golf swing to improve the engagement of ball with club and subsequently improve ball control, trajectory and speed. Further the golfing apparatus includes a movable member configured to slide along a path defined by the guide member and coupled with the putter handle. The guide member is afixed to the waist of a golfer. The guide member is curved to follow a natural rotation of arms and shoulders of the golfer and can be adjusted for proper angle that best fits a golfer's stance and has a second planar back stop surface to further align and control the movement of the putter club head, thereby assisting the golfer in putting.

6 Claims, 9 Drawing Sheets

GOLF PUTTING TRAINING AID

BACKGROUND

The invention relates generally to golf training aids, and more particularly, golf putting training aids to improve a user's swing. Putting is an important aspect of golf. During putting, the golfers generally bend towards a golf ball, and hit the golf ball with a golf club for displacing the golf ball towards an aimed hole on the golf course.

However, such striking of the golf ball often fails to displace the golf ball substantially closer to the aimed hole. Accordingly, golfers both experienced and beginners repeatedly practice putting strokes aiming to accurately put the golf ball in the aimed hole. However, since arms, wrists and body of golfers are unrestrained, every golf stroke may result in a different and inconsistent swing of the golf club.

Figure 1:
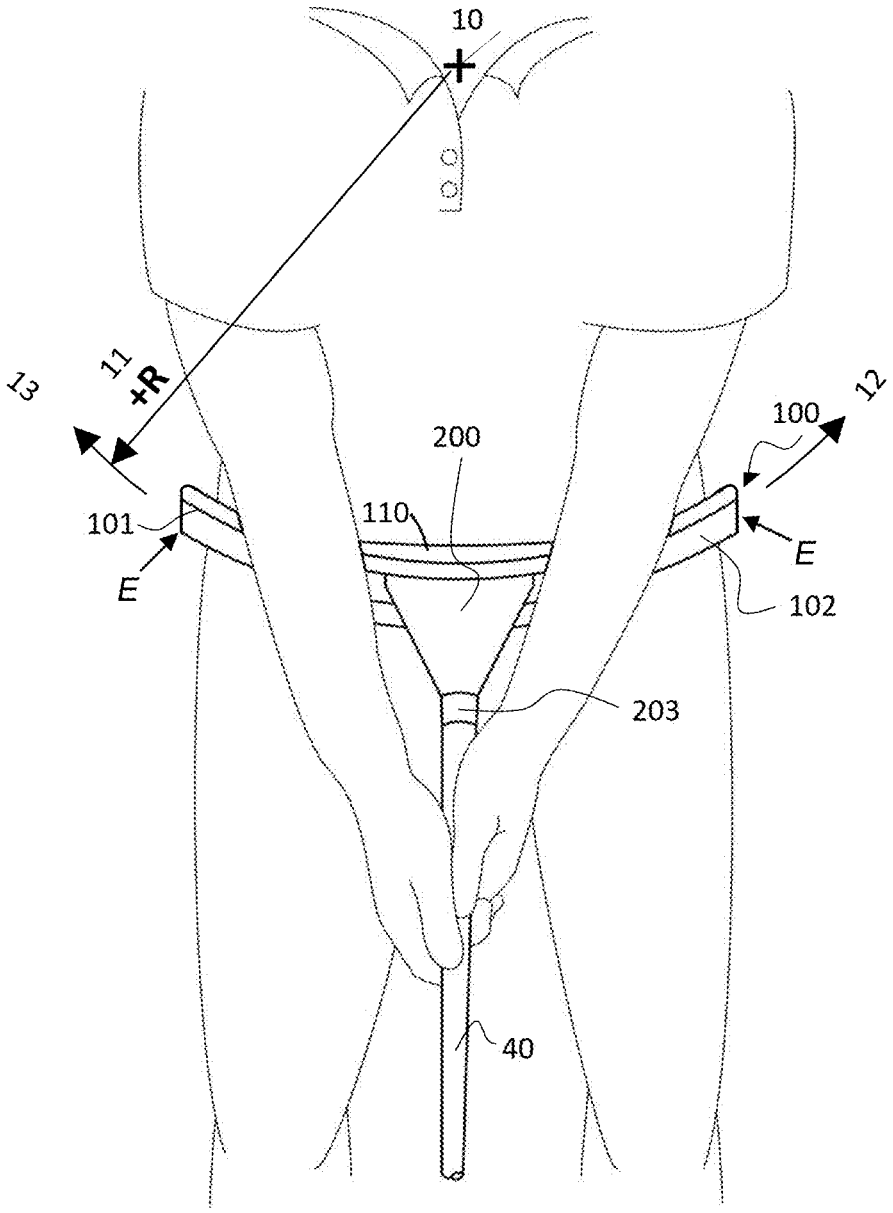
FIG. 1 is a front view of the golf putting training aid apparatus secured to the waist of a partial golfer standing in the putting position and having a putter received therein.

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label. The advances and features of the present disclosure will become better understood with reference to the following detailed description and claims taken in conjunction with the accompanying drawing, in which:

SUMMARY OF THE INVENTION

In one aspect, the present invention is a training apparatus to assist a golfer in performing a putt on a golf ball by allowing only certain necessary body motions and restraining and inhibiting certain other body motions. The training apparatus inhibits any wrist motions and guides the shoulders and arms together as a rigid unit through the full swing of the golf club, including the back swing and the forward swing and strike of the golf ball. The training apparatus may also provide a visual indication of hip position and assist the golfer from rotating the hips through the swing.

One embodiment of a golfing apparatus, for assisting a golfer in playing golf may include a guide member attached to a belt secured to the waist of the golfer. The guide member is aligned with respect to the ground plane and communicates the proper swing path to the hands of the golfer through a movable member adapted to receive a handle portion of a golf club The free travel of the movable member along the curve in the guide member may steer the swing of the golf club received in the moveable member, thereby assisting the golfer in playing golf.

The foregoing and other objects, features, and advantages of the invention will become more apparent from the following detailed description, which proceeds with reference to the accompanying figures wherein the scale depicted is approximate

DETAILED DESCRIPTION OF THE INVENTION

Reference Listing (10) Center of Radius
(11) Swing Radius
(12) Fore stroke trajectory
(13) Back stroke trajectory
(20) Vertical Plane normal to ground along intended putting trajectory and through eye point
(21) Plane normal to the ground and extended from the vertical back surface 102 of apparatus
(30) Angle α of belt face with carrier guide angle
(40) Golf Club
(41) Golf Club Head
(50) Angle β of golf club shaft with plane of carrier block
(60) Intended path of the golf ball
(100) Guide Angle
(100*a*) Radial Leg
(100*b*) Vertical Leg
(101) Curved Radial Surface
(102) Back Surface
(103) Front Surface
(104) Lower Surface
(105) Belt Attachment Clips
(106) Guide Hinge
(110) Conformal Pad
(200) Carrier Block
(200*a*) Carrier Block in shifted position
(201) Carrier Block Slip Surface
(201*a*) Carrier Block Vertical Slip Surface
(202) Throat
(202*a*) Angular adjustment joint
(203) Club handle adaptor
(300) Belt
(301) Strap
(302) Belt Buckle

DEFINITIONS

Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-9, a golfing apparatus is for assisting a golfer in putting. Specifically, the golfing apparatus may be attached to a belt and secured around the waist of a golfer. A putter or other golf club that may be substituted to make a putt or chip stroke may be attached to the golfing apparatus. The golfing apparatus is adapted to guide the swing of the putter, thereby assisting the golfer in taking putting or chip shots. Further the golfing apparatus also assists the golfer in maintaining the proper posture and swing form. In addition, the golfing apparatus restrains movements of the wrist while aligning the swing path of the golf club head 41 in a plane. It provides a visual cue to the golfer for any hip rotation that may misalign the swing trajectory. The golfing apparatus described herein encourages a muscle memory by emphasizing and isolating the proper movements of the golf putting swing so that the golfer has less degrees of freedom to control. By focusing on only an isolated degree of movement, the golfer can achieve a superior degree of control of golf club head speed and improve both alignment of the golf ball's trajectory and distance traveled. The particular design and arrangement of features in the golfing apparatus described herein enable the golfer to perform a proper putting stroke while preventing errant motions that affect ball control.

Referring to FIG. 1, this depicts one embodiment and shows respectively a golfer in the putting stance and holding a golf putter 40 attached to a carrier block 200 through a club handle adaptor 203. The carrier block is brought in contact with a guide angle 100 and sliding freely along a curved radial surface 101 arc segment that terminates at ends (E) on the left and right side, and the arc segment has a center of radius 10 located in proximate position of golfer's upper chest and lower neck region around the sternum and on the golfer's vertical plane of bilateral symmetry. The carrier block 200 slides along the curved radial surface, 101 and a planar back surface 102 guiding the motion trajectories of a back stroke 13 and fore stroke 12. In other embodiments, the back surface 102 and the curved radial surface are blended with a fillet. The carrier block 200 may then be in direct communication with the fillet area. In some implementations, the length of the carrier block may be adjusted by interchanging handle adaptorsof different lengths—or, the handle adaptor or that portion of the carrier block mating with the handle adaptor may be configured to telescope. Alternately, the end of the handle adaptor facing the carrier block may be threaded such that the distance between the handle adaptor and the carrier block can be adjusted.

The ideal swing radius 11 of the curved radial surface 101 would vary with the height of the golfer. Because of proportionate arm and torso lengths, a short golfer would swing along a smaller swing radius 11 and a taller golfer a larger swing radius 11. In some embodiments, the swing radius 11 for an adult golfer would be between 18 and 27 inches depending on their height, uprightness of stance, and relative lengths of arm and torso to their height. For other embodiments, a child's apparatus may have a swing radius 11 shorter than 18 inches depending on their bodies' relative proportions of torso, and length of arms. The disclosure herein refers to a swing radius or radial arc segment, and in other embodiments, other types of curve segments may be used and approximated such as an elliptical arc, and other portions of a parabolic, trigonomial, or other polynomial curve of various degrees can also be used to guide the motion of the hands and wrists through the golf swing.

FIGS. 1-9 and the description thereof are arranged for a right handed golfer. In one embodiment, the golfing apparatus can be fitted to either a right handed or left handed golfer. The swing radius 11 symetrically guides back stroke 13 and fore stroke trajectories 12 and motions. In other embodiments, the guide angle 100 is proportioned for a combined motion path, of a backswing and a fore swing. In the particular illustrated implementation, the apparatus is asymetric and meant solely for right handed or left handed golfers. The arc segment of the carrier guide angle 100 should be sufficient to capture the whole range of putter motion from a full backswing to a full foreswing and allow for maximum putting distances. In some embodiments the arc segmant is between 9 and 18 inches. In other embodiments the arc segment is between 10 and 13 inches.

Figure 2:
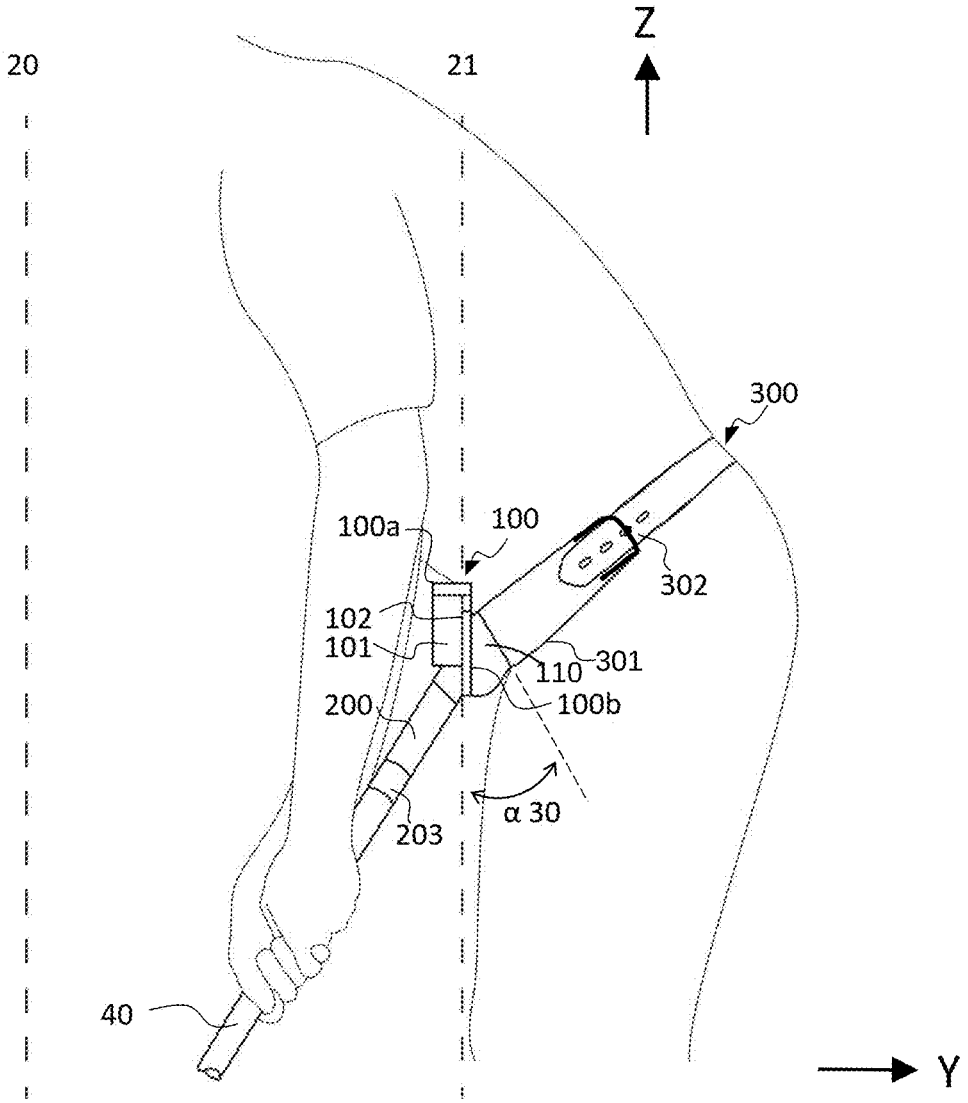
FIG. 2 is a side elevation view rotated 90° relative to that of (FIG. 1), showing the golf putting training aid apparatus secured to the waist of the partial golfer standing in the putting position and having a putter received therein.

As shown in FIG. 2 the golfer is in the proper putting stance. The golfer is holding a golf putter 40 attached to a carrier block 200 through a club handle adaptor 203. The carrier guide angle 100 is aligned with respect to the golfer's stance. The front portion of the waist of the golfer is at an angle $\alpha$ 30 with a plane normal to the ground 21 and extended from the vertical back surface 102 of apparatus. The angle $\alpha$ 30 may vary depending on the physique of the golfer. In some embodiments, the angle $\alpha$ 30 may be adjustable. The carrier guide angle 100 is designed to be in a position where the back surface 102 of the carrier guide angle 100 is aligned in verticle plane 21, approximately normal to the ground surface and parallel to a vertical plane normal to ground along intended putting trajectory 20. The back surface 102 is contained on the vertical leg 100*b* of the guide angle 100. The curved radial surface 101 is contained on the lower side of the radial leg 100*a* of the guide angle 100. The golfing apparatus may be affixed to a waist belt 300. In some embodiments, the waist belt buckle 302 may be positioned at the side of the golfer's waist to avoid interference with the attachment of the apparatus to the belt strap 301. In another embodiment, the apparatus can be attached and removed from a standard belt.

Figure 3:
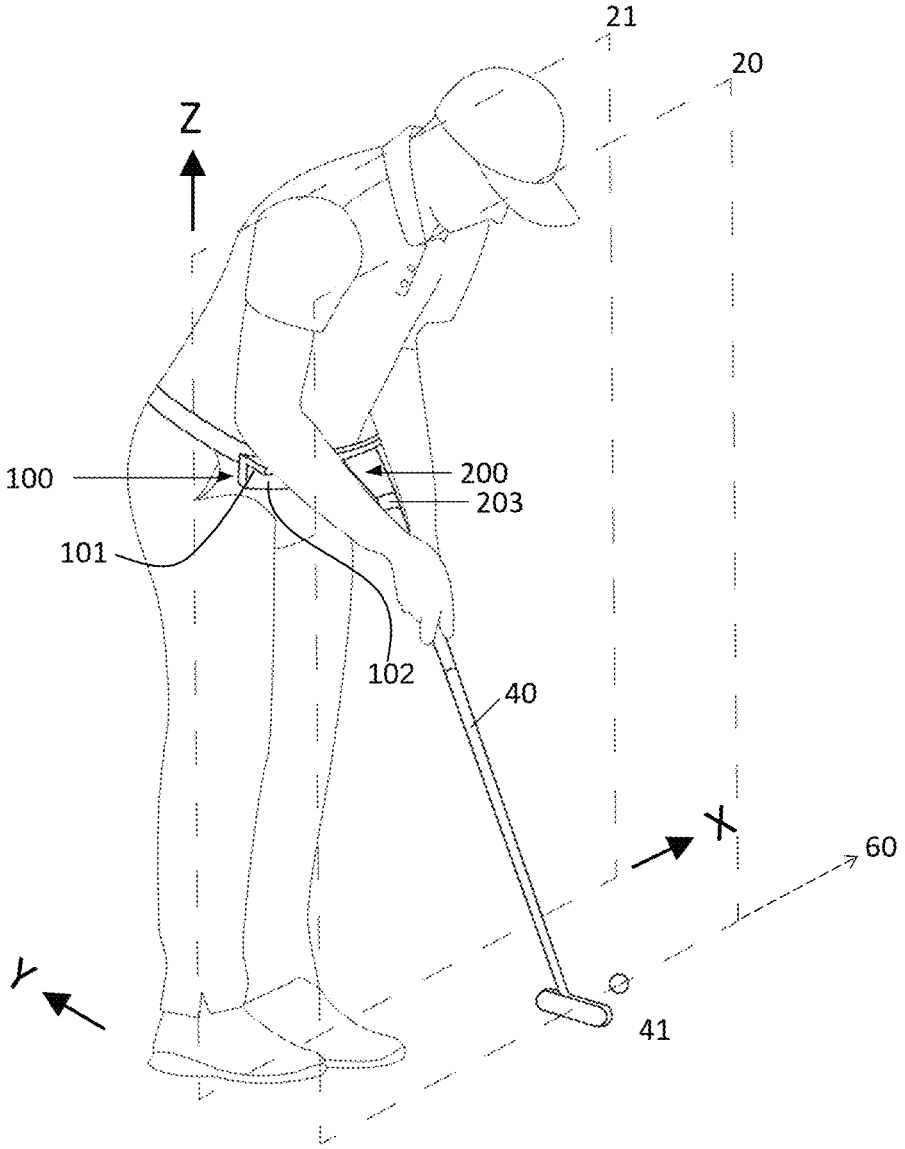
FIG. 3 is a perspective view of a golfer putting with the training aid apparatus secured to the waist and having a putter received therein.

As shown in FIG. 3, when the golfer is in the putting stance, the golfer is looking straight down over the top of the putter head in the plane 20. As the golfer takes a proper swing at the ball, the track of the head of the putter stays in plane 20 normal to the ground and the eyes remain fixed directly over the track of the golf club head. This defined motion ensures the striking surface of the putter head contacts the golf ball normal to the intended line of action of the golf ball 60. The motion of the putter head 41 is controlled by constraining the motion of the upper and back edges of the carrier block 200 along a parallel plane 21 passing through the back surface 102 of the guide angle 100 and along the radial surface 101.

As shown in FIG. 3, the head 41 of the golf putter 40 is kept in the vertical plane normal to ground along intended putting trajectory 60 by the constraint of the motion from the sliding contact of the carrier block 200 wedged between the the curved radial surface 101 and the back surface 102 of the the carrier guide angle 100. The apparatus guides the golfer to keep their waist from rotating by aligning the carrier guide angle 100 with the intended path of the golf ball 60 during the entire stroke. The intended path of the golf ball is in the X direction. The Y direction is pointed from behind the golfer and the Z direction upward and normal to the ground plane. The golfer's shoulders, arms,and wrist should be locked together as a rigid body. This rigid collection of body parts should rotate and wind up along an axis approximately along the spine of the back with the arms in a fixed position relative to the shoulders and with putter 40 held in a fixed position with the hands relative to the shoulders and arms The golfer's awareness of any motion of the hips is enhanced from a visual cue as the guide angle 100 shifts position through the swing. The golfer maintains a constant upward pressure on the golf club putter 40 during the swing providing continous contact between the carrier block 200 wedged between the the curved radial surface 101 and the back surface 102 of the carrier guide angle 100. The carrier 200 freely slides up against the curved radial surface 101 of the carrier guide angle 100 as the golfer reaches back 13 as shown in FIG. 1 and then strokes the putter forward 12 to contact the ball.

During a typical untrained, or unasisted golf putting stroke the track of the putter head can deviate from the defined motion and strike the golf ball at an angle to the intended line of action 60 or strike the surface while moving lateral or normal to the intended line of motion 60 during contact between the striking surface of the putter head 41 and the golf ball, an unintended golf ball response will occur. Then, the golf ball will take an unintended path and a spin can be imparted on the golf ball that causes the golf ball to curve off the line of action. Conversely, the golf putting training aid apparatus is designed to align the golfer's stance and maintain the proper aligment through the stroke, thereby increasing muscle memory of the motion and aiding the golfer in replicating the motion without the training aid.

In order to properly position the carrier guide angle 100 to the golfer's physique, the mounting angle $\alpha$ of the carrier guide angle 100 with the face of the belt 30 should be adusted such that the curved radial surface 101 is in a vertical plane 20 normal to the ground surface and equal distance from each of the golfer's left and right toes when the golfer is in the putting stance. In one embodiment, this angle is adjustable using a guide hinge 105. In another embodiment, the angle is determined for the golfer's physique, body structure, and stance and the carrier guide angle 100 manufactured with the customized angle incorporated into the part.

Figure 4:
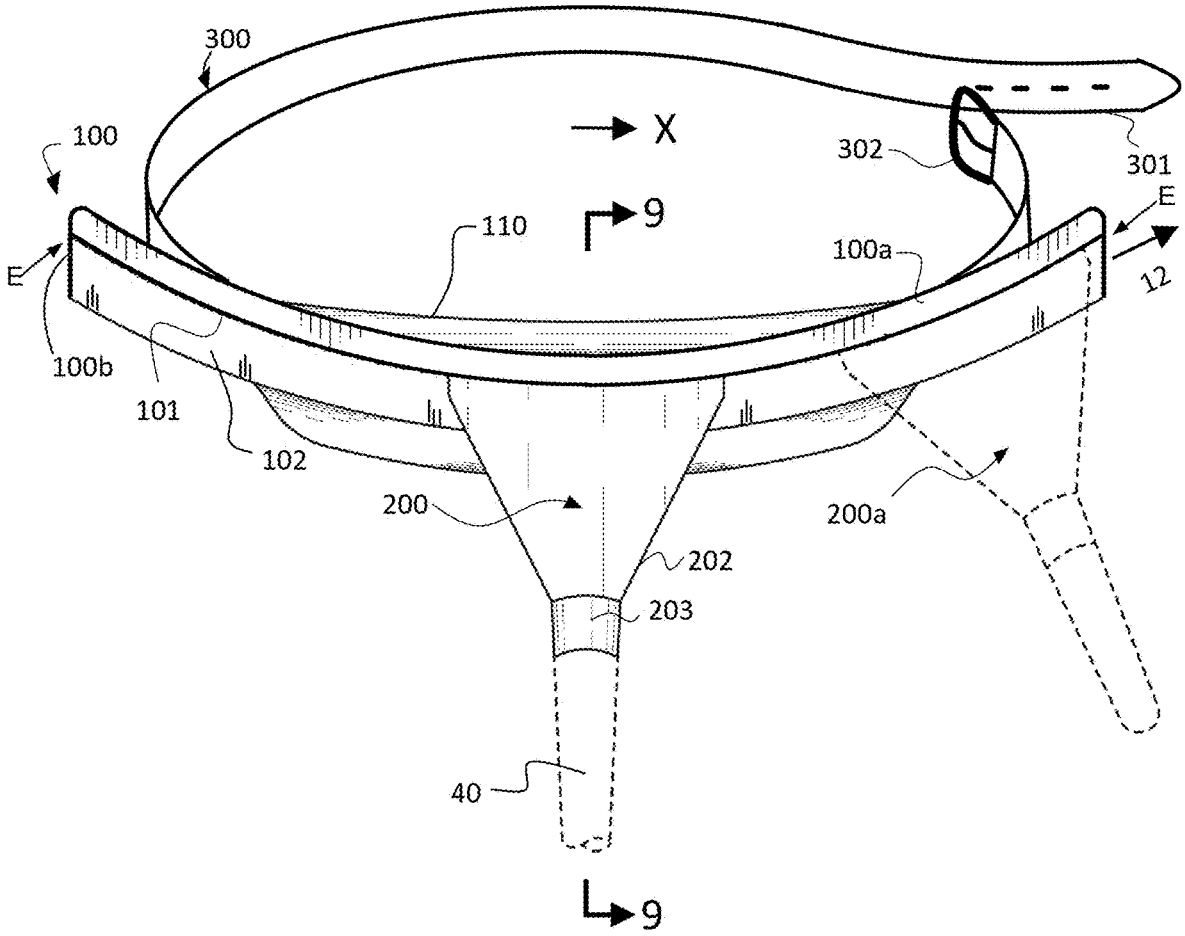
FIG. 4 is an enlarged front view taken in the direction of the Y axis as shown in FIG. 2 of golf putting training aid apparatus as in (FIG. 1) with the partial golfer removed.

As shown in FIG. 4 the carrier block 200 is shown in the neutral position and a phantomed position of the carrier 200*a* is in a rotated position relative to the the carrier guide angle 100 during the end of the stroke from a right handed golfer along the fore stroke trajectory 12. The conformal pad 110 adapts the golfer's physique to the approximate vertical plane 21 shown in the plane of the view and passing through the back surface 102 of the vertical flange 100*b* of the angle guide 100. The belt 300 with strap 301 is unsecured from buckle 302. The golf club 40, depicted as phantomed in FIG. 4 is, attached to the throat 202 of the carrier 200 with a club handle adaptor 203. The curved radial surface 101 shown on the lower side of the radial flange 100*a* of the angle guide 100.

Figure 5:
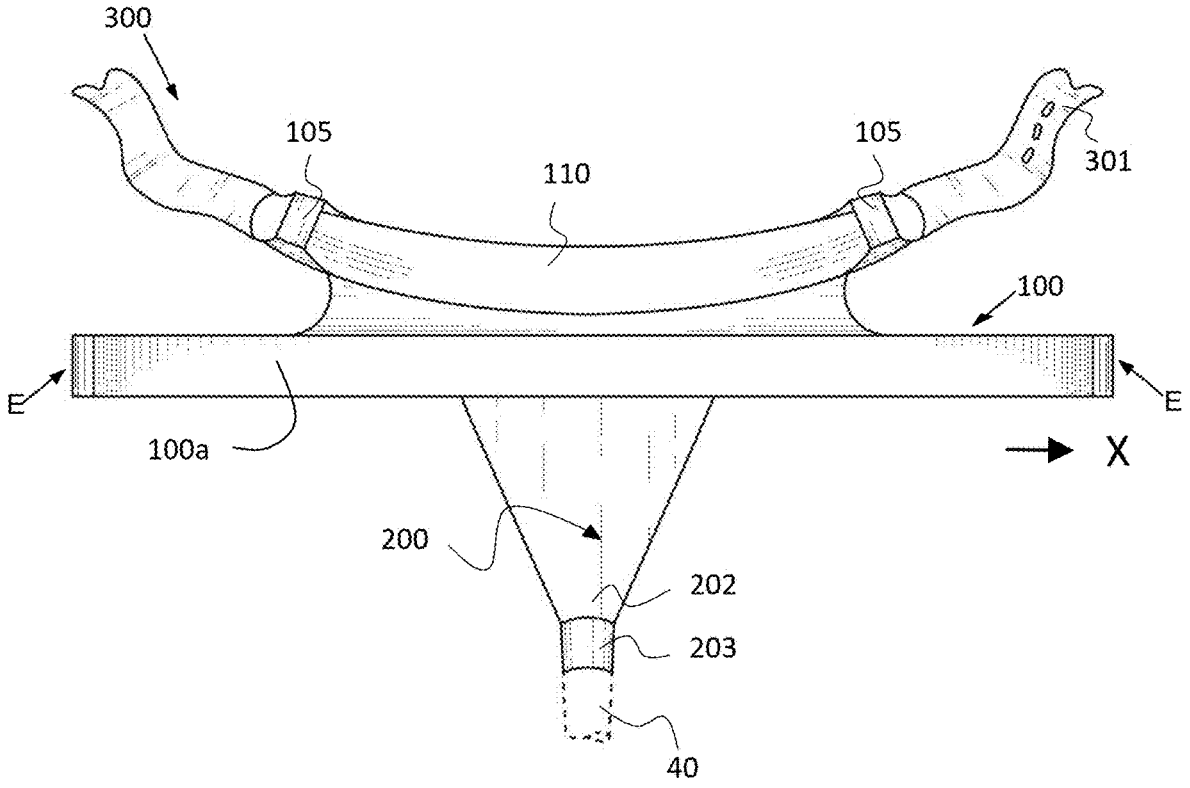
FIG. 5 is a top view of golf putting training aid apparatus.

As shown in FIG. 5, the carrier guide angle 100 is affixed to the front center portion of a belt 300 through belt attachment clips 105. The belt strap 301 passes through the belt attachment clips 105 mounted on the carrier guide angle 100 and secures the carrier guide angle 100 against the body of the golfer. The belt can be tightened through a buckle, ratchet, clamp, or other tightening means 302. In some embodiments the guide angle 100 assembly clips on to a standard belt with the buckle 302 in the front position behind the carrier block in the neutral position.

Figure 6:
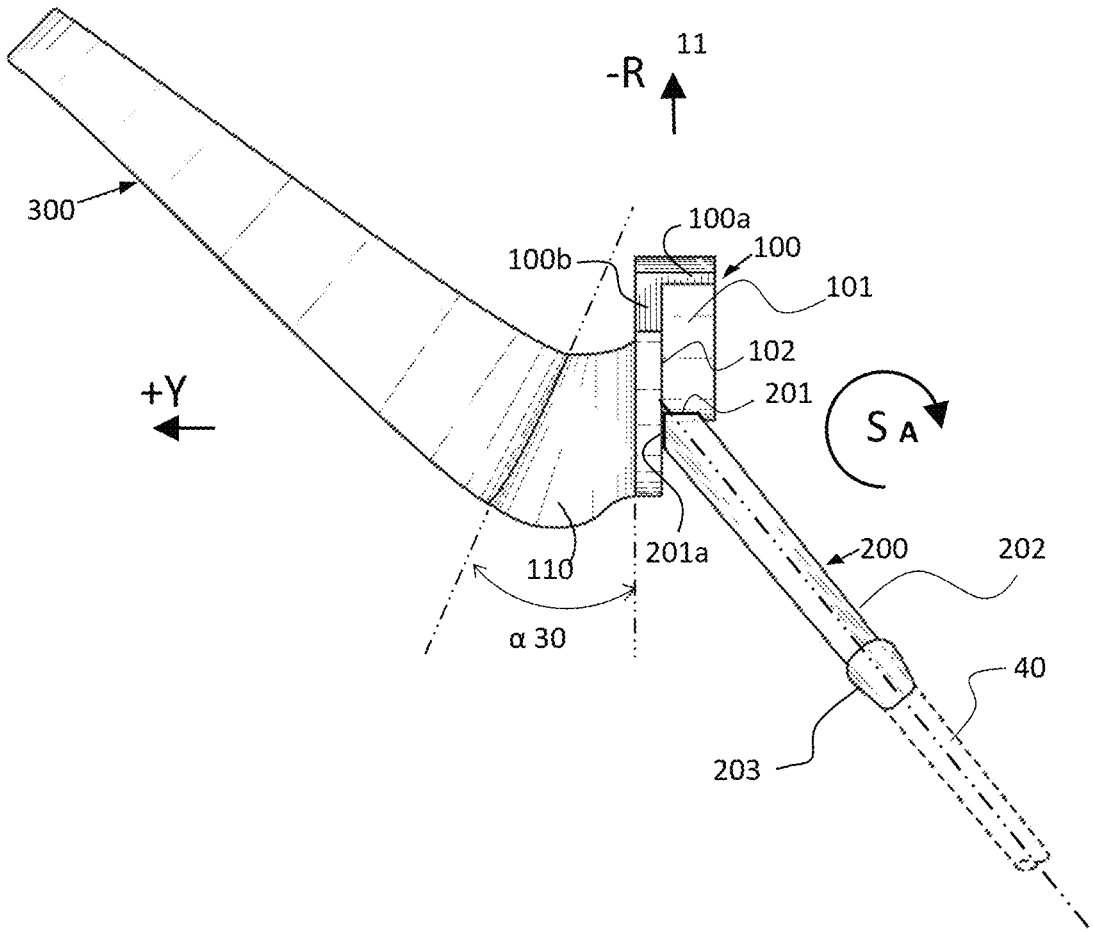
FIG. 6 is an enlarged side view of golf putting training aid apparatus.
Figure 9:
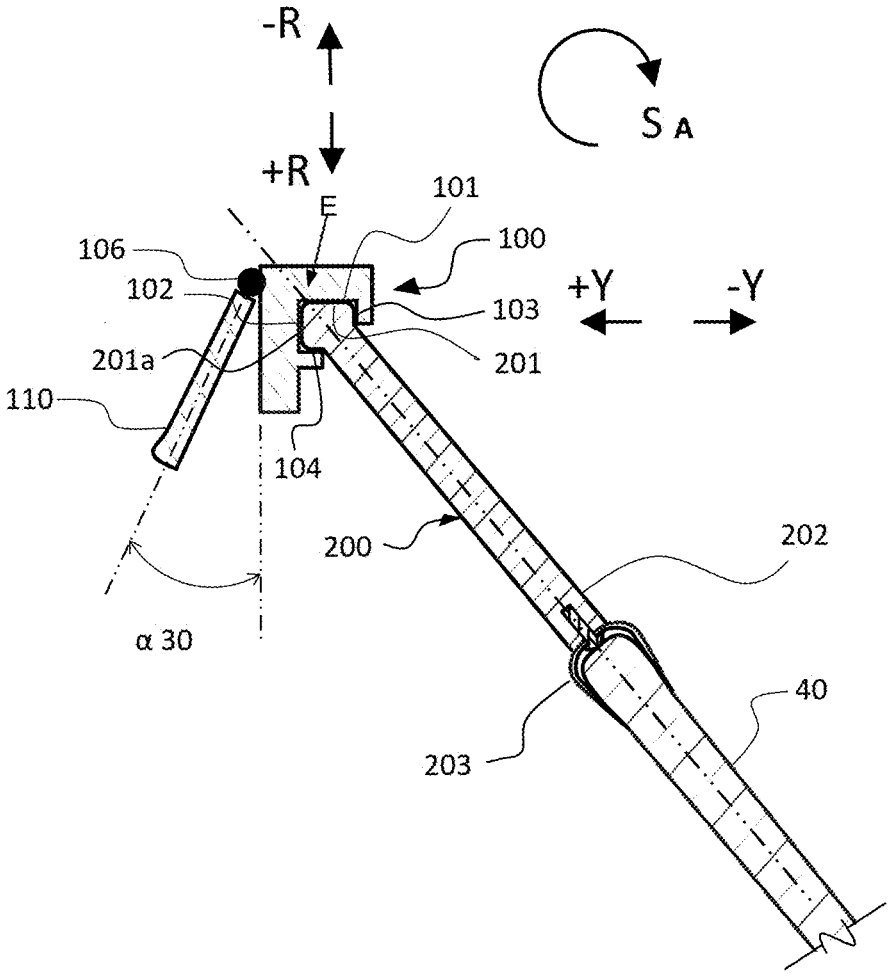
FIG. 9 is a cross sectional view of FIG. 4 taken along lines 9-9 of (FIG. 4), however showing another embodiment according to the present invention, where instead of a fixed conformal pad 110, the conformational pad is adustable and instead of a separable carrier 200, the separable carrier 200 is retained and not directly separable by simple translaton in the −Z and −Y directions from the guide angle 100.

As shown in FIG. 6, a carrier block 200 has slip surfaces 201 and 201*a* that remain in contact with the curved surface 101 of the carrier guide angle 100 and the back surface 102 during the stroke of the putter. The slip surfaces between the curved radial surface 101 and the carrier block slip surface 201, and the back surface 102 and the carrier block vertical slip surface 201*a* can be enhanced by using low friction materials such as a polished surface or TEFLON™ or another low friction material on one of the surfaces and TEFLON™ or felt on the other. In other embodiments, the wheels and bearings can be affixed to carrier block 200 to enable it to roll along the carrier guide angle 100. Upward pressure imparted by the golfer keeps the carrier 200 in contact with the guide 100. The guide 100 traps the carrier 200 and controls its position in the −R swing radial direction 11 with center of radius 10 as shown in FIG. 1 and +Y axis directions. Rotation of the carrier along the stroke arc direction $S_A$ is also restricted to some degree by the squared up and aligned connection between the mating surfaces 201 against 101 and 201*a* against 102. The golf club 40 is affixed to the carrier 200 throat 202 with a club handle adaptor 203, although any number of means can be used to affix the club handle to the carrier block with varying degrees of rigidity, FIG. 6 also shows a deformable conformal cup handle adaptor 203 that can accomodate various golf club handle shapes and cross section profiles. A cross sectional cut through the club handle adaptor is shown in FIG. 9.

Figure 7:
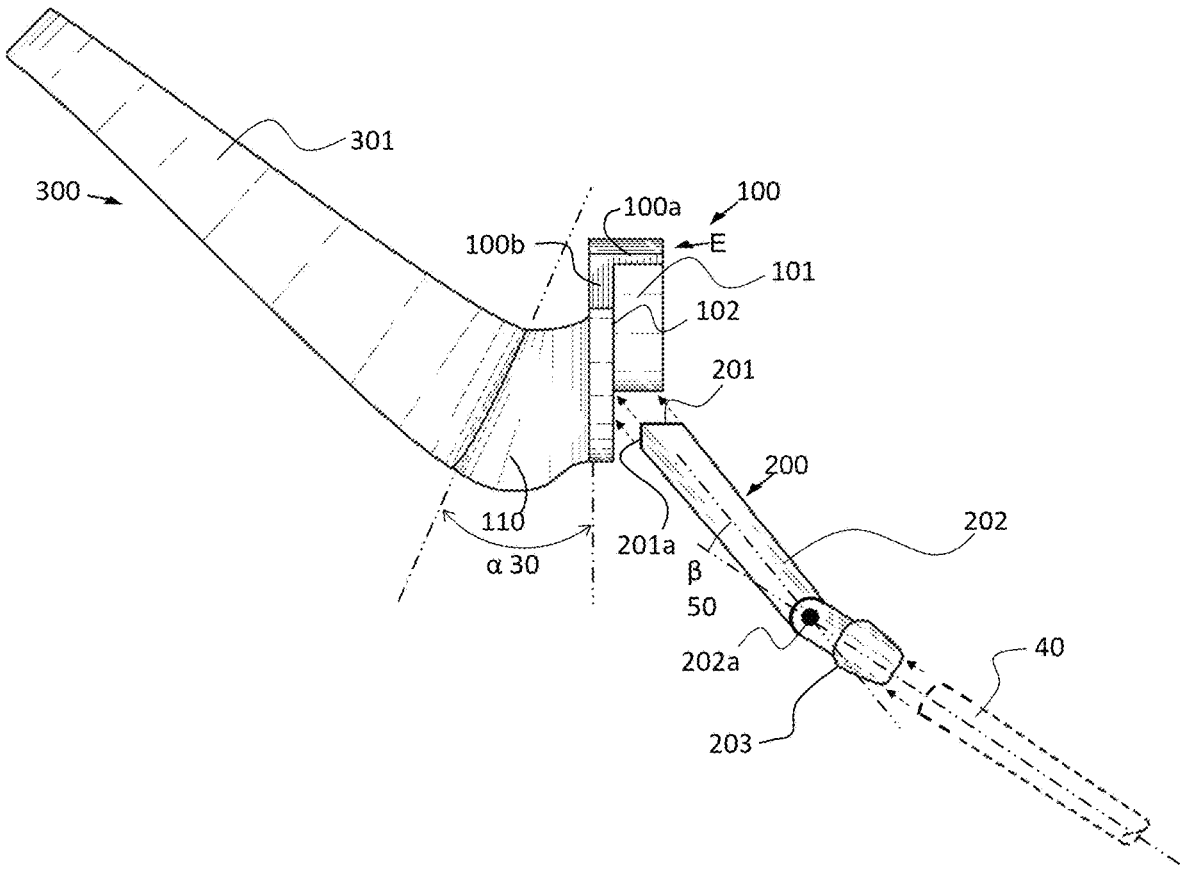
FIG. 7 is a side view of golf putting training aid apparatus with the carrier block 200 shown separted from the guide angle 100 and the phantomed golf club 40 separated from the club handle adaptor 203.

As shown in FIG. 7 the carrier block 200 is in a position separated from the carrier guide angle 100. In one alternate embodiment, there is an adjustment means to change the angle $\beta$ 50 of golf club shaft 40 with the plane of carrier block 200. The angular adjustment joint 202*a* is also shown in FIG. 8 and can be used to maintain full contact between the carrier slip surface 201 and the curved radial surface 101 while also maintaining alignment with the back surface 102 and the 265 vertical contact surface 201*a*.

The golfer applies an upward force through the golf putter handle that keeps the carrier block 200 pressing against the carrier guide angle 100. To prevent the golfer's wrists from rolling during the stroke, an additional back surface 102 of the carrier guide angle 100 prevents the rotation of the carrier block 200 along the axis of the golf putters handle.

The golfer attaches a putter to the club handle adaptor 203. The club handle adaptor 203 is flexible and conforms to various shapes of golf putter handles and grips the handle such that the handle is affixed to the club handle adaptor 203 and, in some embodiments, the golf putter is prevented from rotating along its handle axis. The club handle adaptor 203 is fixed to the carrier block 200 through a throat 202 transition. The golf putter held in the proper position will take on an angle of the golf putter shaft 50 with the plane of the carrier block 200. An adjustment in the angle 50 can be made at the angular adjustment joint 202*a* as shown in FIGS. 7 and 8.

Figure 8:
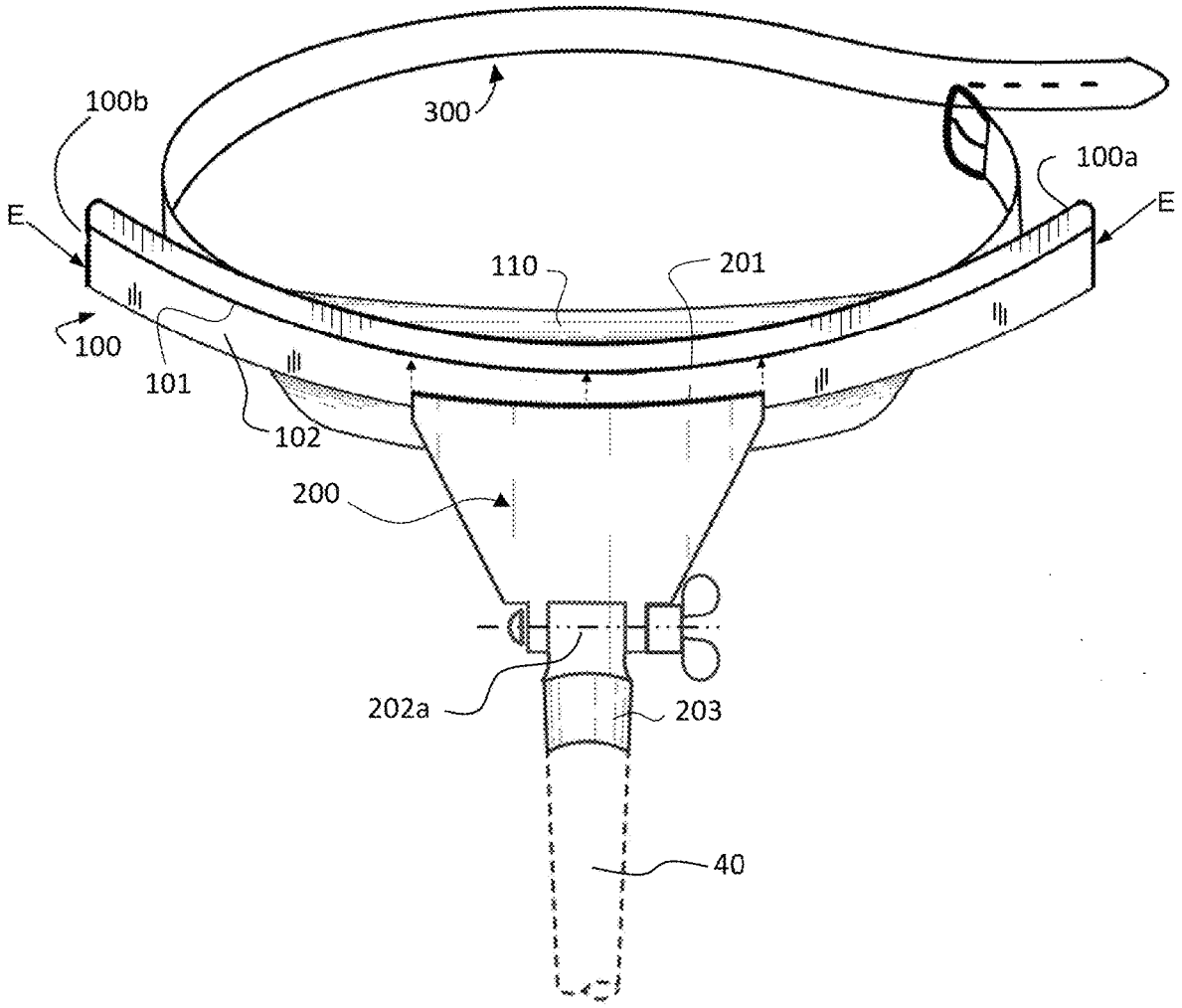
FIG. 8 is a frontal view of golf putting training aid apparatus with the carrier block 200 shown separted from the guide angle 100.

FIG. 8 also shows the carrier 200 assembly separated from the guide 100 assembly. The carrier slip surface 201 is separable from the curved radial surface 101. The curved radial surface 201 is depicted similarly in FIG. 4 on the lower surface of an arc shaped flange as part of the guide 100 and shown in FIG. 6 as the lower surface of a flange extending in a direction normal to the vertical plane 21 as shown in FIG. 3 out from and over the vertical flange on the guide 100

FIG. 9 depicts still another alternate embodiment where additional constraints are added between the carrier 200 and the carrier guide 100. In addition to the contact mating surfaces 201 and 201*a* on the carrier 200 against 101 and 102 on the guide 100 that restrain motion in the +Y and −R directions, there are other features that constrain motion of the carrier 200 in the opposite −Y and +R directions, the front surface 103 and lower surface 104 on the carrier guide 100 respectfully. In this alternate embodiment, the carrier 200 is not separable during a normal golf putting swing, but can be still be separated from the guide 100 by extending the carrier along the backstroke trajectory 13 or along the forestroke trajectory 12 as shown in FIG. 1 beyond their normal stroking range and freeing the carrier 200 from the guide channel formed by the surfaces 101, 102, 103, and 104. In addition to the extra restraint for the radial and fore and aft traslational directions, the carrier 200 is also restrained from rotating about the stroke arc $S_A$, 12 & 13 swept by the radius R 11 as shown in FIG. 1.

In other embodiments, the carrier can be roller mounted on a track and made to be separable from the track or not separable. In some embodiments the track is contained inside a housing. The track can be a curved flat section oriented similarly to the radial flange 100*a*. In still another embodiment, the carrier can ride on a rod afixed on either distal end to and contained inside a housing. The housing contains a slot allowing an attachment rod to extend outward and connect to the golf club handle 40 and mounted on the back side to a conformal pad 110 and waist belt 300.

While the embodiments described herein are susceptible to various modifications and alternative forms and specific embodiments have been shown by way of example in the drawings, the exemplary embodiments described herein are not intended to be limited to the forms disclosed. Rather, the instant disclosure covers all modifications, equivalents, and alternatives falling within the scope of the appended claims.

The initial training method first properly fits the Golf Putting Training Apparatus to the golfer's height, physique and golfing stance. The swing radius is matched within a range of the golfer's height. The first steps properly fit the Golf Putting Training Apparatus, and then use the apparatus to correct any erratic stroke motions to gain a consistent swing. After swing consistency is achieved, the apparatus is used to master repeatable directional accuracy and precision on a flat surface. Next, putting distance is matched to the amount of back swing and calibrated. And finally, the technique is extended to a contoured putting green where the break must be anticipated and compensated for. These steps are:

Step 1: Properly match the size of the Golf Putting Training Apparatus with the golfer's height, physique and putting or chipping stance. The stance angle can be observed and measured and the radius adjusted accordingly by switching out sizes. A more upright stance and taller height requires a larger size apparatus with a larger swing radius.

Step 2: Align the back surface 102 of guide angle 100 to a vertical plane 21 by custom fitting a conformal pad 110 or adjusting the angle 30 $\alpha$ the position of the belt face with the plane normal to the ground plane 21.

Step 3: Attach top of golf club 40 with club handle adapter 203 and let arms hang freely down from shoulders and grip the golf club handle as if addressing the golf ball with eyes directly over the position of the golf ball.

Step 4: Loosen any adjustment features including 1) extension of carrier block throat 202 that changes length of carrier block; 2) angular adjustment joint 202*a* that adjust angle $\beta$ 50 between club shaft and carrier block 200.

Step 5: Seat bearing interface surfaces of carrier block 200 with guide angle 100 including carrier block slip surface 201 with curved radial surface 101 and carrier block vertical slip surface 201*a* with back surface 102. Tighten adjustment features to retain them in proper position.

Step 6: Starting with a level putting surface such as a floor, address golf ball in the putting stance and align straight angle guide 100 with intended direction of ball 60 toward a target. Apply enough pressure up through the golf shaft to trap the carrier block 200 firmly against the angle guide 100 during all portions of the swing. Concentrate on holding hips in position by keeping angle guide 100 pointed to intended direction while winding upper body into the backswing. Initiate swing while wrists are locked by unwinding upper body through the intended direction of ball 60 toward the target.

Step 7: Repeat swing until body is able to go through motion with only light force required to trap the carrier block 200 firmly against the angle guide 100 during all portions of the swing and the ball's trajectory is consistently toward the target.

Step 8: Continuing with a level putting surface such as a floor, work on putting distance by placing a reference mark on the angle guide 100 and carrier block 200 to denote the stop or pause point of the backswing. Concentrate on bringing the backswing to this point then proceeding with forward swing and note distance ball is traveling. Once the ball is traveling consistently to a given distance, make another mark on the angle guide 100, either extending or contracting backswing to increase or reduce ball travel distance. Practice consistently putting the ball to longer and shorter distances. In some implementations, marking the angle guide may include a clip that is attached to the angle guide at any point along the carrier block path to serve as a stop for the carrier block. Alternately, the guide angle may include a series of small apertures whereby a pin or post may be inserted to serve as a stop. In this way, the arc length of the swing may be adjusted according to the observed travel distance of the ball.

Step 9: Next address putting stance on an actual putting green. Anticipate any break in a contoured putting green by compensating the intended direction of ball 60 slightly left or right of the cup target. Repeat swing concentrating on maintaining the alignment of guide angle with the adjusted target. It may help to place a coin or similar flat object at the exact spot that is aimed. It may also help to have a spotter or golf trainer verify that the direction of angle guide 100 remains fixed on intended target through all portions of the swing. The golf training apparatus is useful in this mode to help a trainer assess a golfer's swing for directional accuracy and precision.

Step 10: Next continue to address putting stance on an actual putting green. Using the marks placed on the angle guide 100 in Step 8 anticipate whether the putt is up hill and adjust putt to a longer stop position to compensate. After gaining confidence for slightly uphill putts, try slightly downhill putts shortening stroke accordingly. It may also help to have a spotter or golf trainer verify that the extent of backswing remains fixed and doesn't go past the intended mark. The golf training apparatus is useful in this mode to help a trainer assess a golfer's swing for distance.

Step 11: Next combine controlling trajectory break with distance on an actual putting green while simulating play. In some embodiments, the angle guide 100 is easily released and removed from the golfer's belt while maintaining proper alignment and fit. That way the golfer can engage in tee offs and approaches to green and incorporate the chipping and putting skills learned from using the Gold Training Apparatus with all aspects of the game.

What is claimed is:

1. A golf putting training apparatus comprising:

a guide angle member including two terminal ends, a planar back surface extended to the terminal ends, the planar back surface adjustable to a vertically planar disposition with respect to a ground surface;

a movable carrier block including:

a slip surface defining a proximal portion configured for planarly slidable translation in a rightside to leftside direction or a leftside to rightside direction over the bearing surface, and a distal portion configured to couple with a putter handle;

a mounting member for mounting the apparatus to a user's waist;

an angle adjustment member including a moveable pad for adjusting an angle of the planar back surface with respect to the ground surface.

2. The guide angle member according to claim 1, wherein the planar back surface adjoins a curved radial surface, such that a middle portion of the radial surface is inferior to portions of the radial surface at the terminal ends when the planar back surface is vertically disposed relative to the ground surface.

3. The distal portion according to claim 1 further comprising an angularly positionable coupler.

4. The guide member according to claim 1, further comprising one or more retention members configured for engagement with the proximal portion of the moveable carrier block.

5. A method of using a golf putting training aid comprising the steps of:

providing a curved radial surface including two terminal ends and a conjoined planar surface that is angularly adjustable with respect to a ground surface via an angle adjustment member that includes a moveable pad capable of tilting the planar surface, the curved radial surface is configured to mate with a carrier block, a radius of the curved radial surface selected according to a user's measurements, the carrier block configured to support a handle end of a golf club;

attaching the curved radial surface to the user's waist;

adjusting an angle of the curved radial surface such that the conjoined planar surface is vertical with respect to the ground surface;

attaching the handle end of the club to the carrier block;

mating a portion of the carrier block to the radial surface;

holding the handle of the club and using the radial surface as a guide, moving the club in a putting motion.

6. The method according to claim 5 further comprising the step of marking distances on the curved radial surface to delimit the arc length of a putting motion.

* * * * *